US010113722B2

(12) United States Patent
Al-Khulaifi

(10) Patent No.: US 10,113,722 B2
(45) Date of Patent: Oct. 30, 2018

(54) ROTATING MULTI-SOCKET LIGHT FIXTURE

(71) Applicant: Khaled A. M. A. A. Al-Khulaifi, Safat (KW)

(72) Inventor: Khaled A. M. A. A. Al-Khulaifi, Safat (KW)

( * ) Notice: Subject to any disclaimer, the term of this patent is extended or adjusted under 35 U.S.C. 154(b) by 0 days.

(21) Appl. No.: 15/885,590

(22) Filed: Jan. 31, 2018

(65) Prior Publication Data

US 2018/0224094 A1 Aug. 9, 2018

Related U.S. Application Data

(60) Provisional application No. 62/456,676, filed on Feb. 9, 2017.

(51) Int. Cl.

| | |
|---|---|
| ***F21S 8/02*** | (2006.01) |
| ***F21V 21/04*** | (2006.01) |
| ***F21V 19/04*** | (2006.01) |
| ***F21V 21/15*** | (2006.01) |
| ***F21V 23/04*** | (2006.01) |

(Continued)

(52) U.S. Cl.

CPC ..... *F21V 19/04* (2013.01); *F21S 8/026* (2013.01); *F21V 21/04* (2013.01); *F21V 21/15* (2013.01); *F21V 21/36* (2013.01); *F21V 23/0435* (2013.01); *F21V 23/06* (2013.01)

(58) Field of Classification Search

CPC ..... F21V 23/0435; F21V 23/06; F21V 21/04; F21V 21/15; F21V 21/36; F21V 19/04; F21S 8/026

See application file for complete search history.

(56) References Cited

U.S. PATENT DOCUMENTS

| | | | | |
|---|---|---|---|---|
| 1,174,240 A * | 3/1916 | Dussaud | ..... | B60Q 1/124 362/233 |
| 1,955,616 A * | 4/1934 | Wallace | ..... | F21V 19/04 340/331 |
| 2,551,029 A | 5/1951 | MacKay | | |

(Continued)

FOREIGN PATENT DOCUMENTS

| | | |
|---|---|---|
| DE | 3920494 A1 | 1/1991 |
| DE | 9311156 U1 | 10/1993 |
| DE | 9319274 U1 | 2/1994 |

*Primary Examiner* — Anh Mai
*Assistant Examiner* — Arman B Fallahkhair
(74) *Attorney, Agent, or Firm* — Ricard C. Litman

(57) ABSTRACT

The rotating multi-socket light fixture may be used in combination with a ceiling panel or the like, allowing for changing of light bulbs for a recessed light, for example. The rotating multi-socket light fixture includes a plurality of light bulb sockets mounted circumferentially on a wheel for respectively removably receiving a plurality of light bulbs. The wheel is mounted on, and rotationally driven by, a rotational drive motor. The rotational drive motor is mounted on a vertical support such that the rotational drive motor may be vertically adjusted with respect to the vertical support. A vertical drive motor may be mounted on an upper end of the vertical support for selectively driving vertical translation of the rotational drive motor with respect to the vertical support. A lower end of the vertical support is mounted on an upper surface of the ceiling panel, such that the vertical support extends upwardly therefrom.

5 Claims, 5 Drawing Sheets

(51) Int. Cl.
*F21V 21/36* (2006.01)
*F21V 23/06* (2006.01)

(56) References Cited

U.S. PATENT DOCUMENTS

| | | | | | |
|---|---|---|---|---|---|
| 3,416,030 | A | | 12/1968 | Conkling et al. | |
| 4,190,777 | A | | 2/1980 | Luce et al. | |
| 4,232,361 | A | * | 11/1980 | Kelsall | F21S 8/026<br>362/269 |
| 4,402,038 | A | | 8/1983 | Hartung et al. | |
| 4,415,951 | A | | 11/1983 | Recane et al. | |
| 5,023,515 | A | | 6/1991 | Olon et al. | |
| 5,676,452 | A | | 10/1997 | Scholz | |
| 7,311,425 | B2 | * | 12/2007 | Jervey, III | F21S 8/06<br>362/391 |
| 9,746,147 | B2 | * | 8/2017 | Benner | F21V 21/22 |

* cited by examiner

ROTATING MULTI-SOCKET LIGHT FIXTURE

CROSS-REFERENCE TO RELATED APPLICATION

This application claims the benefit of U.S. Provisional Patent Application Ser. No. 62/456,676, filed on Feb. 9, 2017.

BACKGROUND

1. Field

The disclosure of the present patent application relates to light fixtures, and particularly to a rotating multi-socket light fixture for usage with recessed lighting.

2. Description of the Related Art

A recessed light is a light fixture that is installed within a hollow opening in a ceiling. When installed, it provides light that emanates from the hole in the ceiling, concentrating the light in a downward direction as a broad floodlight or narrow spotlight. Because the light bulb of the light fixture is not only mounted in the ceiling, but is at least partially recessed within the ceiling panel, changing the light bulb can be extremely difficult. It would obviously be desirable to be able to avoid or minimize the need to climb a ladder or a similar structure in order to change a light bulb of a recessed light. Thus, a rotating multi-socket light fixture solving the aforementioned problems is desired.

SUMMARY

The rotating multi-socket light fixture may be used in combination with a ceiling panel or the like, allowing for easy and efficient changing of light bulbs for a recessed light, for example. The rotating multi-socket light fixture includes a plurality of light bulb sockets mounted circumferentially on a wheel for respectively removably receiving a plurality of light bulbs. The wheel is mounted on, and rotationally driven by, a rotational drive motor. A hub of the wheel is mounted on an axle of the rotational motor, preferably along a central axis of the hub.

The rotational drive motor is mounted on a vertical support such that the rotational drive motor may be vertically adjusted with respect to the vertical support. Preferably, at least one rail is secured to the vertical support and the rotational drive motor is slidably mounted on the at least one rail. A vertical drive motor may be mounted on an upper end of the vertical support for selectively driving vertical translation of the rotational drive motor with respect to the vertical support. The ceiling panel has opposed upper and lower surfaces, and a lower end of the vertical support is mounted on the upper surface of the ceiling panel, such that the vertical support extends upwardly therefrom.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
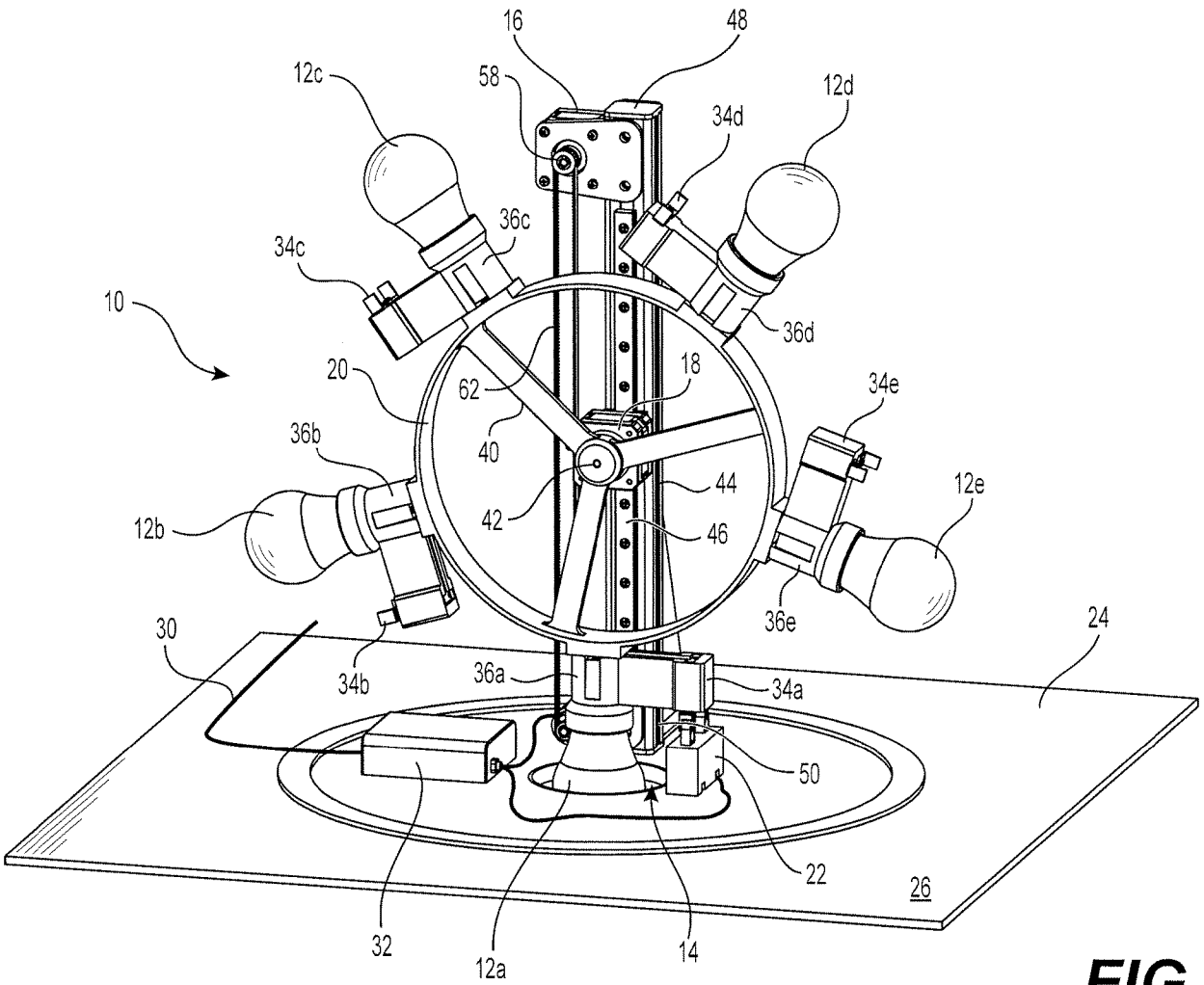
FIG. 1 is a front perspective view of a rotating multi-socket light fixture.

As shown in FIGS. 1-4, the rotating multi-socket light fixture 10 may be used in combination with a ceiling panel 24 or the like, allowing for easy and efficient changing of light bulbs for a recessed light, for example. The rotating multi-socket light fixture 10 includes a plurality of light bulb sockets 36*a*, 36*b*, 36*c*, 36*d*, 36*e* mounted circumferentially on a wheel 20 for respectively removably receiving a plurality of light bulbs 12*a*, 12*b*, 12*c*, 12*d*, 12*e*. It should be understood that the five light bulbs 12*a*, 12*b*, 12*c*, 12*d*, 12*e*, and their corresponding light bulb sockets 36*a*, 36*b*, 36*c*, 36*d*, 36*e*, are shown for exemplary purposes only, and that any desired number of light bulbs and light bulb sockets may be mounted on wheel 20. Further, it should be understood that light bulbs 12*a*, 12*b*, 12*c*, 12*d*, 12*e* and light bulb sockets 36*a*, 36*b*, 36*c*, 36*d*, 36*e* are shown for exemplary purposes only, and that the rotating multi-socket light fixture 10 may be used with any conventional type of light bulbs or other light emitting devices.

The wheel 20 is mounted on, and rotationally driven by, a rotational drive motor 18. A hub 40 of the wheel 20 is mounted on an axle 42 of the rotational drive motor 18, preferably along a central axis of the hub 40. It should be understood that any suitable type of motor or the like may be used to selectively drive rotation of wheel 20. Further, it should be understood that wheel 20 and hub 40 are shown for exemplary purposes only.

The rotational drive motor 18 is mounted on a vertical support 44 such that the rotational drive motor 18 may be vertically adjusted with respect to the vertical support 44. Preferably, at least one rail 46 is secured to the vertical support 44 and the rotational drive motor 18 is slidably mounted on the at least one rail 46. A vertical drive motor 16 may be mounted on an upper end 48 of the vertical support 44 for selectively driving vertical translation of the rotational drive motor 18 with respect to the vertical support 44.

Figure 3:
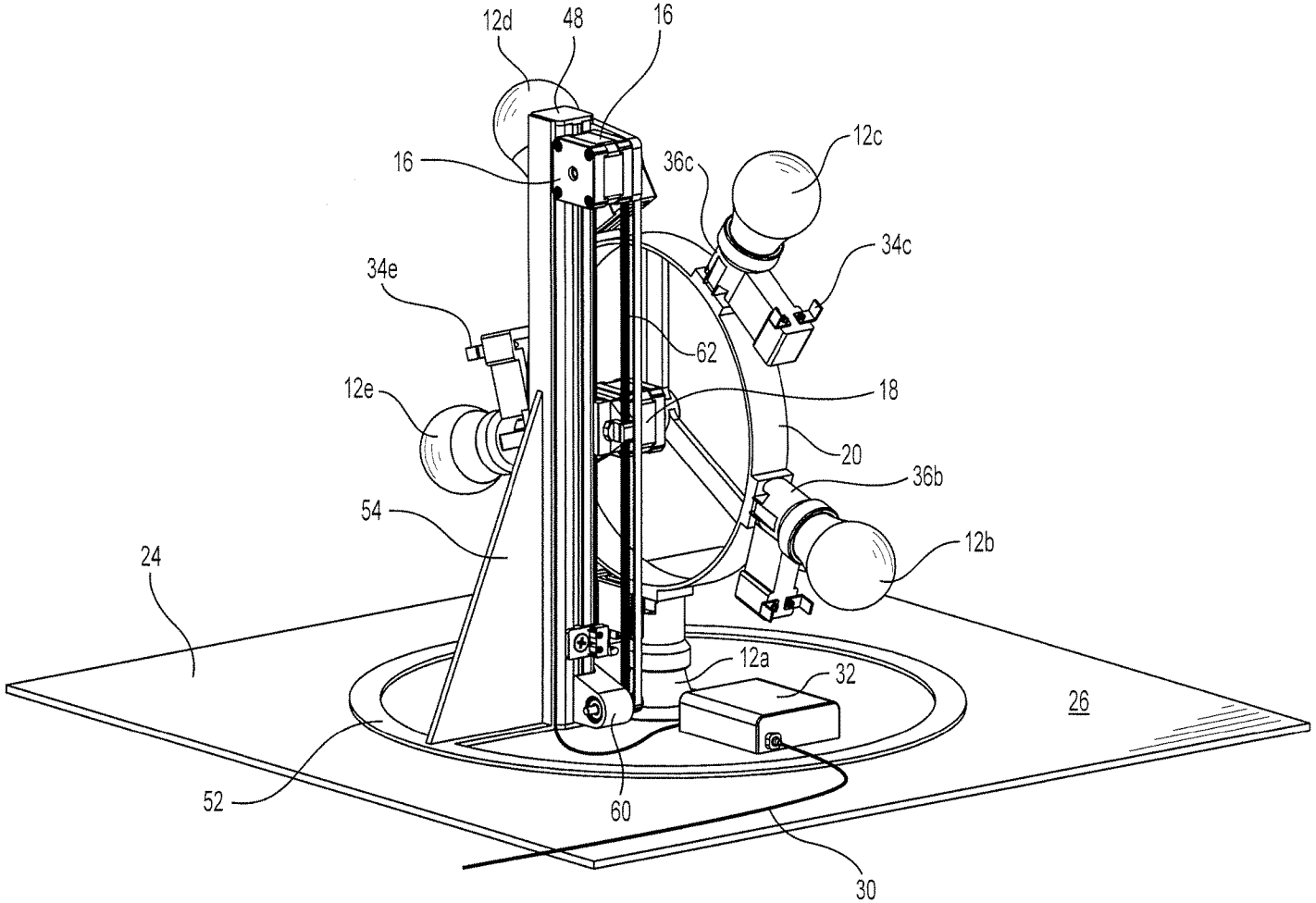
FIG. 3 is a rear perspective view of the rotating multi-socket light fixture.

The ceiling panel 24 has opposed upper and lower surfaces 26, 28, respectively, and a lower end 50 of the vertical support 44 is mounted on the upper surface 26 of the ceiling panel 24, such that the vertical support 44 extends upwardly therefrom. As best shown in FIG. 3, a mounting structure may be provided for securing and stabilizing vertical support 44. In the non-limiting example of FIG. 3, a circumferential base 52 is secured to upper surface 26 of ceiling panel 24, and a substantially triangular-shaped support 54 joins vertical support 44 to base 52.

It should be understood that the rotational drive motor 18 may be selectively translated by any suitable type of vertical drive system. In the non-limiting example shown in FIGS. 1, 3 and 4, upper and lower pulleys 58, 60, respectively, are respectively mounted on the upper and lower ends 48, 50 of the vertical support 44. A continuous belt 62 extends between, and is rotationally driven by, the upper and lower pulleys 58, 60. The rotational drive motor 18 is secured to the continuous belt 62 such that driven rotation of the continuous belt 62 drives the vertical translation of the rotational drive motor 18 with respect to the vertical support 44. In the exemplary arrangement shown in FIGS. 1, 3 and 4, the upper pulley 58 is driven to selectively rotate by the vertical drive motor 16, thus driving rotation of the continuous belt 62 which, in turn, selectively raises and lowers the rotational drive motor 18 with respect to the vertical support 44.

Figure 2:
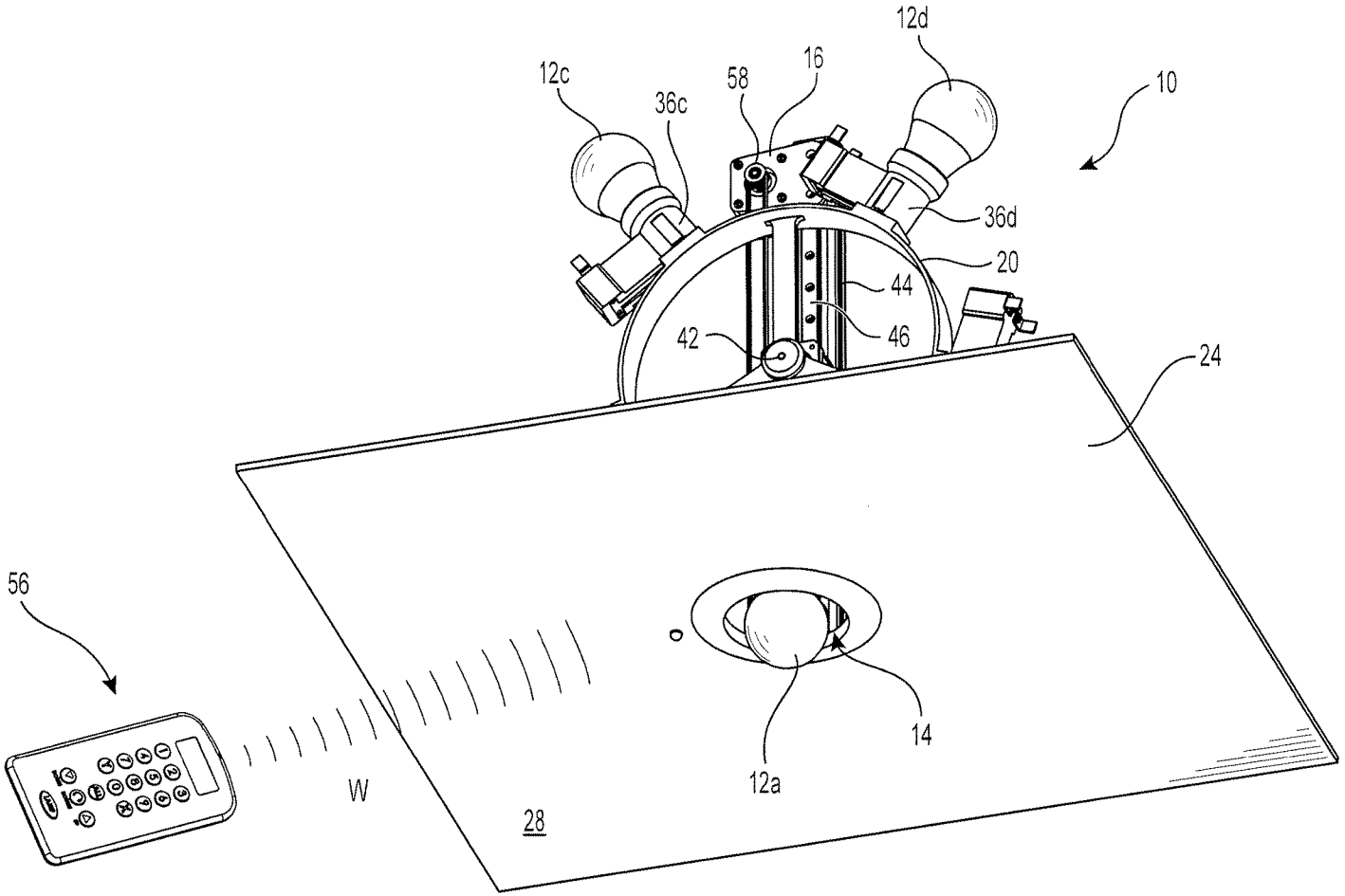
FIG. 2 is a lower perspective view of the rotating multi-socket light fixture.
Figure 4:
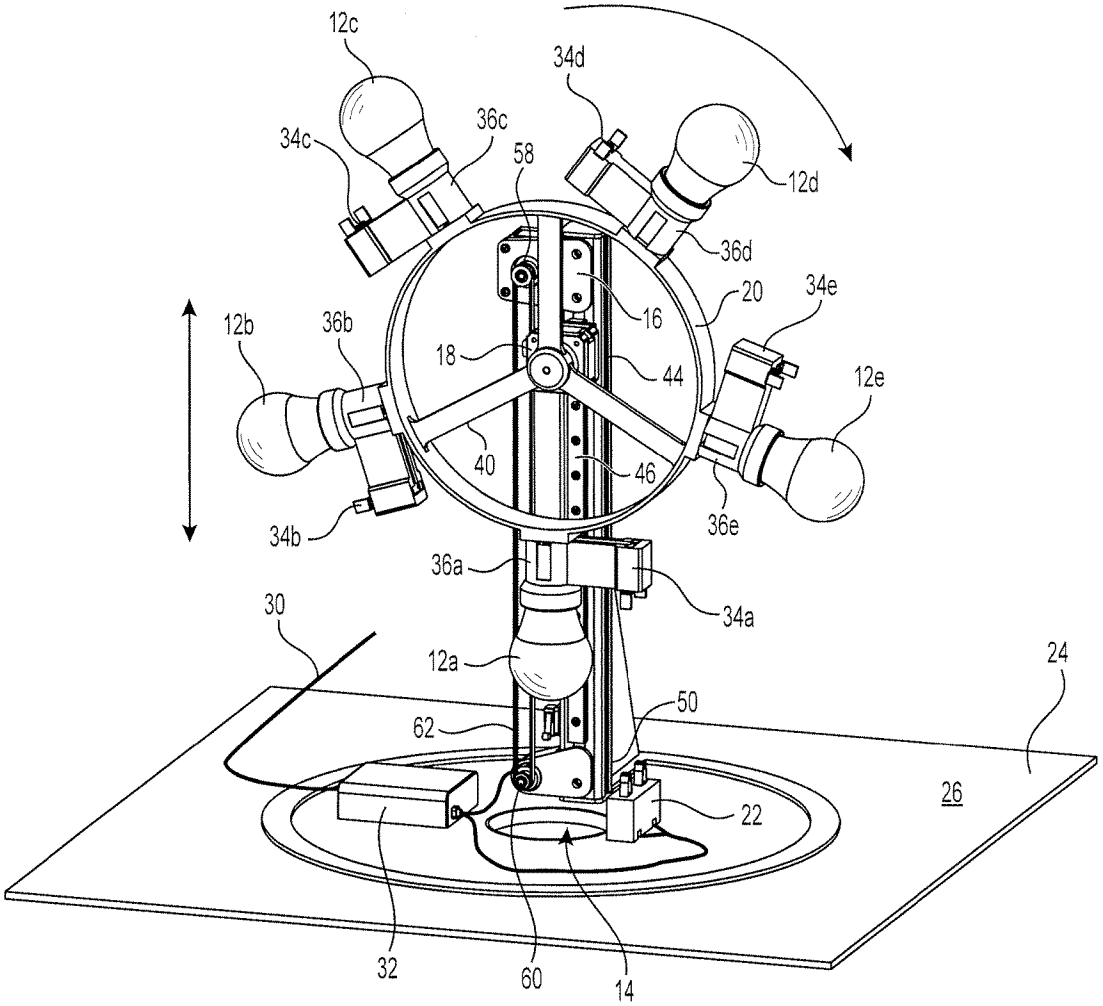
FIG. 4 is a front perspective view of the rotating multi-socket light fixture, shown in a raised configuration.

As best seen in FIG. 4, an opening 14 is formed through the ceiling panel 24 such that a lowermost one of the plurality of light bulbs (i.e. light bulb 12*a* in this example) may at least partially project therethrough. In FIGS. 1-3, the lowermost light bulb 12*a* is shown in place; i.e., partially projecting through opening 14. However, when light bulb 12*a* burns out, vertical drive motor 16 may be actuated to raise rotational drive motor 18 to lift light bulb 12*a* out of opening 14 (as shown in FIG. 4). After light bulb 12*a* has been lifted out of opening 14, rotational drive motor 18 is actuated to rotate wheel 20 such adjacent light bulb 12*e* becomes the new lowermost light bulb (in the exemplary clockwise rotation illustrated in FIG. 4). When new lowermost light bulb 12*e* is vertically aligned with opening 14, rotational drive motor 18 ceases rotation of wheel 20 and vertical drive motor 16 is again actuated to lower light bulb 12*e* to at least partially project through opening 14. It should be understood that the rotating multi-socket light fixture 10 may be used in other situations; e.g., rather than replacing burned out light bulbs, each light bulb 12*a*, 12*b*, 12*c*, 12*d*, 12*e* may have a different color, for example, allowing the user to select a light bulb of a desired color.

As shown in FIGS. 1 and 4, a first electrical connector 22 is mounted on the upper surface 26 of the ceiling panel 24. The first electrical connector 22 is in electrical communication with an external power source, such as a standard A.C. electrical supply, for example, via cable 30. As will be described in greater detail below, a controller 32 is also in electrical communication with the first electrical connector 22, as well as vertical drive motor 16 and rotational drive motor 18. As shown in FIGS. 1 and 4, a plurality of second electrical connectors 34*a*, 34*b*, 34*c*, 34*d*, 34*e* are respectively electrically connected to the plurality of light bulb sockets 36*a*, 36*b*, 36*c*, 36*d*, 36*e*, such that the lowermost one of the plurality of second electrical connectors, corresponding to the lowermost one of the plurality of light bulbs, releasably electrically contacts the first electrical connector 22 to provide electrical power for the lowermost one of the plurality of light bulbs. In the example shown in FIG. 1, second electrical connector 34*a*, corresponding to light bulb socket 36*a* of lowermost light bulb 12*a*, is in electrical contact with the first electrical connector 22. In the example of FIG. 4, in which lowermost light bulb 12*a* has burned out, wheel 12 is raised by vertical drive motor 16, lifting second electrical connector 34*a* out of contact with first electrical connector 22 and breaking the connection. Upon rotation of next light bulb 12*e* into position, and lowering light bulb 12*e* at least partially through opening 14, second electrical connector 34*e* will make electrical contact with first electrical connector 22.

Figure 5:
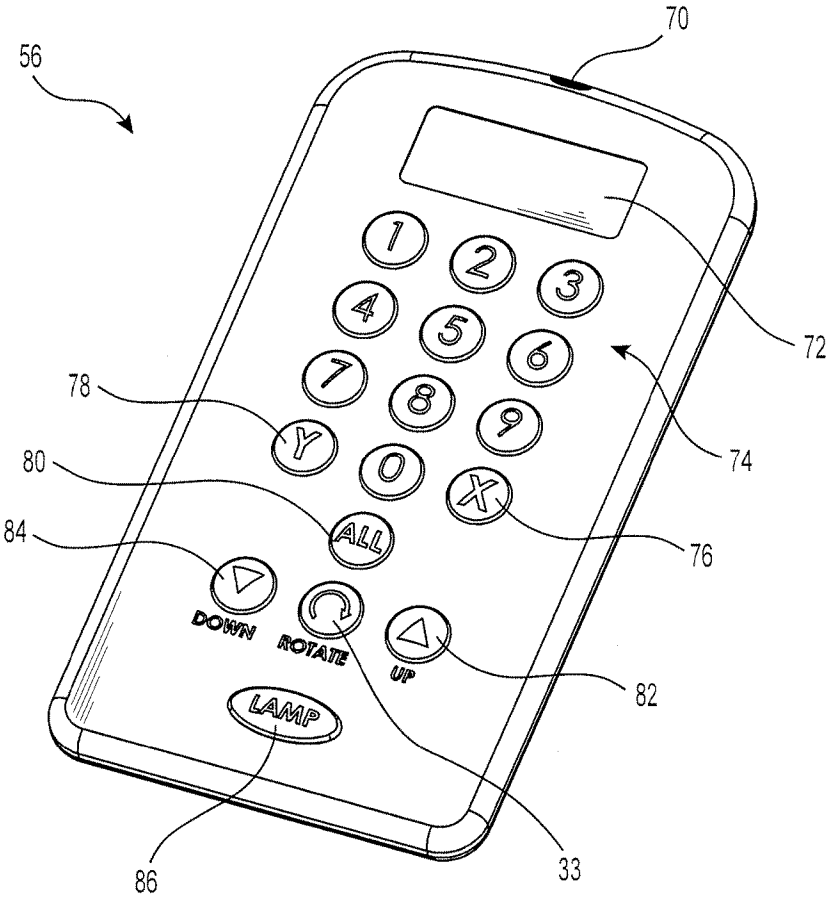
FIG. 5 illustrates a remote control used in combination with the rotating multi-socket light fixture.

As shown in FIG. 2, a remote control 56 may be provided to communicate with controller 32 through wireless signals W. Remote control 56 may be used to provide command signals for controller 32 to selectively actuate vertical drive motor 16 and rotational drive motor 18. As shown in FIG. 5, remote control 56 similar to a conventional remote control, including an emitter 70, which may be an infrared light emitting diode (LED) or the like, a display 72, such as a liquid crystal display (LCD) or the like, and a plurality of buttons 74. It should be understood that remote control 56 may, alternatively, be wired or integrated into a further control system.

The user may, for example, use the numeric ones of buttons 74 to select a particular light bulb (of light bulbs 12*a*, 12*b*, 12*c*, 12*d* and 12*e* in the example given above). It should be further understood that multiple rotating multi-socket light fixtures 10 may be integrated into a ceiling, thus the user may use the numeric ones of buttons 74 in combination with specialized buttons 76, 78 to select a particular light fixture 10 in a ceiling. In this example, button 76 (labeled "X" in FIG. 5) corresponds to a lateral coordinate axis, for example, and button 78 (labeled "Y" in FIG. 5) corresponds to a longitudinal coordinate axis. Thus, by pressing button 76, followed by a number, and then pressing 78, followed by a number, the user may use a Cartesian coordinate system to select a desired one of the light fixtures 10. Additional controls may be provided, such as an "all" button 80, allowing the user to access all light fixtures 10 at once. Additionally, as shown in FIG. 5, "up" and "down" buttons 82, 84, respectively, may be provided for controlling vertical translation of rotational drive motor 18, and a "rotate" button 86 may be provided for controlling actuation of rotational drive motor 18. Activation or deactivation of the selected light bulb (i.e., the lowermost light bulb at least partially projecting through opening 14) may be accomplished through "lamp" button 86.

It is to be understood that the rotating multi-socket light fixture are not limited to the specific embodiments described above, but encompass any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A rotating multi-socket light fixture, comprising:

a wheel, the wheel having a central axis;

a plurality of light bulb sockets mounted circumferentially on the wheel;

a plurality of light bulbs respectively removably received within the plurality of light bulb sockets;

a vertical support, the vertical support including at least one rail secured to the vertical support;

a rotational drive motor adjustably mounted on the at least one rail of the vertical support, the wheel being mounted on the rotational drive motor, the rotational drive motor driving rotation of the wheel about the central axis perpendicular to the vertical support, wherein the rotational drive motor is vertically adjustable with respect to the at least one rail of the vertical support; and a vertical drive motor mounted on the vertical support for providing vertical translation of the rotational drive motor and of the plurality of light bulbs with respect to the vertical support, wherein the vertical translation is provided by:

upper and lower pulleys respectively mounted on upper and lower ends of the vertical support; and a continuous belt extending between, and being rotationally driven by, the upper and lower pulleys, wherein the rotational drive motor is secured to the continuous belt such that driven rotation of the continuous belt drives the vertical translation of the rotational drive motor with respect to the vertical support, wherein the upper pulley is driven to selectively rotate by the vertical drive motor.

2. The rotating multi-socket light fixture as recited in claim 1, further comprising a ceiling panel having opposed upper and lower surfaces, the vertical support being mounted on the upper surface and extending upwardly therefrom.

3. The rotating multi-socket light fixture as recited in claim 2, wherein an opening is formed through the ceiling panel such that a lowermost one of the plurality of light bulbs at least partially projects therethrough.

4. The rotating multi-socket light fixture as recited in claim 3, further comprising:

a first electrical connector mounted on the upper surface of the ceiling panel and being in electrical communication with an external power source; and a plurality of second electrical connectors respectively electrically connected to the plurality of light bulb sockets, such that a lowermost one of the plurality of second electrical connectors, corresponding to the lowermost one of the plurality of light bulbs, releasably contacts the first electrical connector to provide electrical power for the lowermost one of the plurality of light bulbs.

5. The rotating multi-socket light fixture as recited in claim 1, further comprising a remote control for remotely actuating the vertical drive motor and the rotational drive motor.

* * * * *